United States Patent [19]

Manley

[11] 4,125,200

[45] Nov. 14, 1978

[54] SELF-SEALING BOTTLE ASSEMBLY AND METHOD FOR MANUFACTURE THEREOF

[75] Inventor: Chester W. Manley, Pigeon, Mich.

[73] Assignee: John Birka, Dearborn Hgts., Mich.

[21] Appl. No.: 868,923

[22] Filed: Jan. 12, 1978

[51] Int. Cl.[2] ..... B65D 39/06

[52] U.S. Cl. ..... 215/246; 53/488; 215/266

[58] Field of Search ..... 53/42; 215/246, 266, 215/318

[56] References Cited

U.S. PATENT DOCUMENTS

| | | | |
|---|---|---|---|
| 175,952 | 4/1876 | Edwards | 215/266 |
| 277,758 | 5/1883 | Macvay | 215/266 |
| 317,705 | 5/1885 | Beardsley | 215/266 |
| 3,720,343 | 3/1973 | Irish | 215/246 |

FOREIGN PATENT DOCUMENTS

| | | | |
|---|---|---|---|
| 448,446 | 11/1912 | France | 215/266 |

*Primary Examiner*—Donald F. Norton

*Attorney, Agent, or Firm*—Barnes, Kisselle, Raisch & Choate

[57] ABSTRACT

A self-sealing bottle assembly and method of manufacture comprising a glass bottle having an open neck, an annular resilient neck seal disposed on an internal shoulder adjacent the neck opening, a cap of thermosetting plastic material shrink fitted onto the bottle neck to hold the annular seal firmly against the neck shoulder, and a glass sphere captured within the bottle and adapted for internal pressure-sealing engagement with the annular seal.

7 Claims, 5 Drawing Figures

SELF-SEALING BOTTLE ASSEMBLY AND METHOD FOR MANUFACTURE THEREOF

The present invention relates to self-sealing bottle assemblies and to methods for manufacture thereof.

Self-sealing bottles of the subject type are disclosed in the U.S. patents of Macvay et al U.S. Pat. No. 277,758, Beardsley U.S. Pat. No. 317,705 and Midson U.S. Pat. No. 1,000,281, for example, and in the British Pats. of Grimwade No. 49 (1880) and Warner No. 4646 (1881).

The present trend in the bottling industry in many parts of the nation is toward returnable and, in many cases, reusable beverage containers to curb roadside litter and excessive waste. However, returnable bottles and cans do not overcome the problem of litter due to disposable bottle caps and pull-open tabs. Accordingly, it is a general object of the present invention to provide a self-sealing beverage container and a method for manufacturing thereof which has no disposable parts and which is constructed in such a way as to substantially prevent disassembly by the beverage consumer. Another object of the invention is to provide a self-sealing beverage container which may be readily disassembled upon return to the bottler for cleaning and reuse.

The invention, together with additional objects, features, and advantages thereof, will be best understood from the following description, the appended claims and the accompanying drawings in which:

Figure 1:
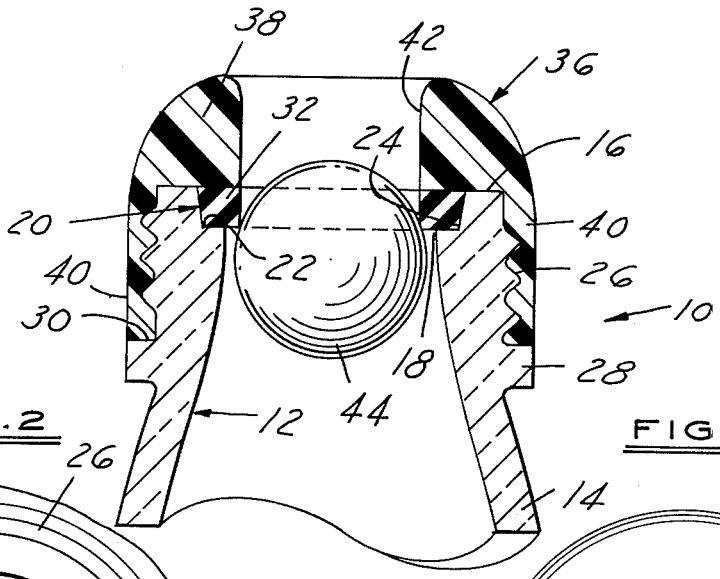
FIG. 1 is a broken elevational view vertically bisecting the neck of a self-sealing bottle provided in accordance with the invention.
Figure 2:
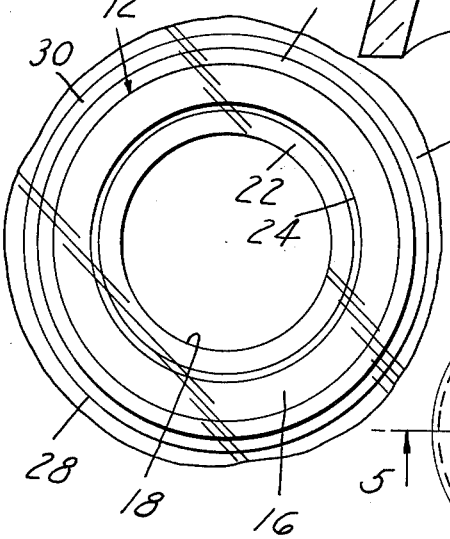
FIGS. 2–4 are respective plan views of the bottle-neck, cap and seal in the assembly of FIG. 1.

Referring to the drawings collectively, a self-sealing bottle assembly 10 in accordance with the invention comprises an elongated hollow bottle neck 12 extending from a bottle body portion 14 and terminating at its body-remote end 16 in a circular opening 18. A shoulder 20 is formed internally of neck 12 and adjacent neck end 16 and comprises an outwardly-directed substantially flat seating surface 22 disposed inwardly of end 16 and a frustoconical radial wall 24 which tapers wideningly from surface 22 to neck end 16. An angle of taper for wall 24 of between 10° and 15° with respect to the neck axis is preferred. The external radial surface of neck 12 adjacent end 16 includes a threaded portion 26 which terminates in a radially outwardly extending shoulder 28 having a flat upper seating surface 30. Bottle neck 12 and body 14 may be integrally formed of glass or other like material using any of the usual conventional methods. That portion of body 14 not illustrated in FIG. 1 is preferably of substantially the same configuration as that shown in the above-referenced Midson patent, for example.

An annular seal 32 of rubber or other like resilient material is disposed on shoulder 20. As illustrated in FIG. 1, the inside diameter of seal 32 is substantially uniform and is slightly less than the inside diameter of neck opening 18, while the outside diameter and radially outer surface 34 of seal 32 tapers wideningly in correspondence with shoulder wall 24. The thickness of seal 32 is preferably equal to or slightly greater than the depth of shoulder 20 axially of the bottle neck. A cap 36 of thermosetting plastic resin or the like is received by shrink fit over neck end 16 and comprises an apertured body portion 38 which captures seal 32 firmly against shoulder surfaces 22,24 and a skirt portion 40 extending axially from body portion 38 to envelop threaded neck portion 26 and seat against the surface 30 of shoulder 28. As shown in FIG. 1, the diameter of the aperture 42 in cap body portion 38 is less than that of neck opening 18, and preferably is substantially equal to the inside diameter of seal 32.

A sealing element 44, preferably a glass ball or sphere having a diameter less than that of opening 18 but greater than the inside diameter of seal 32, is captured within bottle 10. As is well known in the art, injection of fluid under pressure into the bottle forces ball 44 upwardly into sealing engagement with an opposing edge of seal 32 as shown in FIG. 1. To open the bottle, ball 44 may be pressed downwardly by a user's finger inserted through cap aperture 42 such that the pressurized gas is permitted to escape around the ball. When the pressure within the bottle is at atmosphere, ball 44 will drop downwardly by force of gravity and thereby permit fluid to be poured from bottle neck opening 18.

In accordance with an important aspect of the invention, bottle assembly 10 is preferably constructed by first providing the glass bottle as hereinabove described and dropping ball 44 therein. Seal 32 is then located on shoulder 20. Cap 36 is then either molded in situ or press fitted over neck 12 while still in a hot resilient or semi-resilient condition. As cap 36 thereafter cools and shrinks, skirt portion 40 fills the gaps between the neck threads and tightly grips the bottle neck. At the same time, body portion 38 presses seal 32 into firm engagement with shoulder 20.

Figure 3:
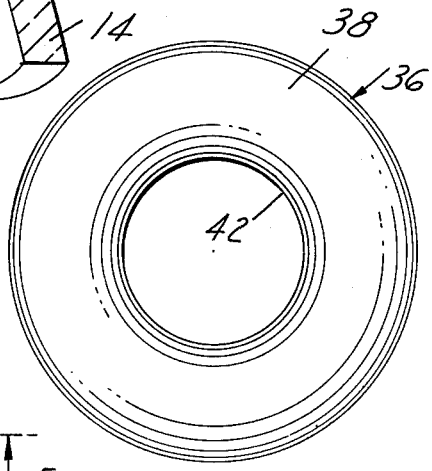
Figure 4:
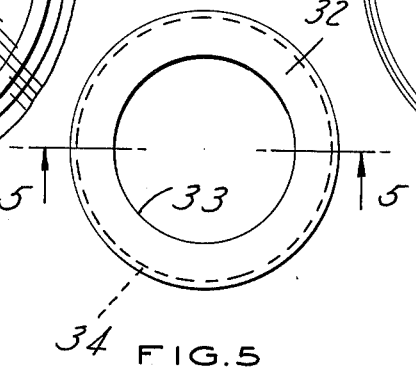
Figure 5:
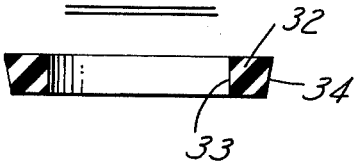
FIG. 5 is a sectional view taken along the line 5—5 in FIG. 4.

Thus, cap 36 and seal 32 cooperate to provide an airtight seal around neck end 16. Moreover, the preferred shrink-fit operation combined with the contour of the cap renders bottle assembly 10 extremely difficult for a consumer to disassemble. More specifically, cap 36, which may be of polypropylene PP23M2 marketed by Abbott Laboratories of Paramuts, N.J. under the trademark ELREXENE, preferably has a smooth outer surface as best seen in FIG. 3 which combines with its relative rigidity upon hardening to prevent obtaining a good grip on the cap for twisting the same relative to the bottle. Upon return to the bottler, however, the cap may be removed by suitable mechanical means, after which the cap and seal may be discarded and the bottle and ball cleaned for reuse. In the latter respect, it is of particular significance that the diameter of the ball is less than that of the neck opening, such that the former may be withdrawn for separate cleaning when the cap and seal are removed.

Although the invention has been described with respect to a presently preferred embodiment thereof, many alternatives, modifications and variations are envisioned. For example, seal 32 may be formed as part of cap 36 rather than as a separate unit. Similarly, discontinuities other than threads 26 may be provided, such as recesses or channels in the neck outer surface, to receive portions of cap skirt 40 upon cooling and hold cap 36 firmly on neck 12 against removal in the axial direction. Threads 26 are presently preferred to facilitate removal of cap 36 by the bottler. However, the invention is intended to embrace the above-noted and all other alternatives and modifications as fall within the spirit and broad scope of the appended claims.

The invention claimed is:

1. A self-sealing bottle assembly comprising a glass bottle which includes an elongated hollow neck terminating in a bottle opening, first means forming a shoulder at said opening internally of said neck and second means forming a plurality of discontinuities on the external surface of said bottle neck extending around said external surface of said bottle neck extending around said external surface adjacent said opening; an annular resilient seal seated on said shoulder; a cap of thermosetting plastic material received by shrink fit onto said neck and having a body portion which captures said seal firmly against said shoulder and a skirt portion extending from said body portion externally of said neck to envelop said discontinuities; and a glass sphere captured within said bottle and adapted for internal sealing engagement with said seal.

2. A self-sealing bottle assembly comprising a bottle which includes a hollow neck terminating at a neck end in a substantially circular bottle opening having an opening diameter, first means forming an internal shoulder in said bottle neck at said opening, said shoulder having a substantially flat seating surface axially inwardly of said bottle opening and a radial wall surface which tapers wideningly from said seating surface to said neck end, and second means forming a threaded external surface on said bottle neck adjacent said neck end; an annular resilient seal disposed on said shoulder having an internal diameter which is less than said opening diameter and an outside diameter which tapers wideningly in correspondence with said wall surface; a cap received over said neck end having an apertured body portion which captures said seal firmly against said seating surface and said wall surface and a skirt portion extending from said body portion in threaded engagement with said second means on said neck; and a sphere captured within said bottle and adapted for internal sealing engagement with said seal, said sphere having a dismeter which is less than said opening diameter but greater than said internal diameter such that removal of said cap permits removal of said seal and said sphere, the aperture in said cap being of sufficient diameter to permit access to said sphere when in sealing engagement with said seal.

3. The self-sealing bottle assembly set forth in claim 2 wherein said bottle further includes third means forming a second shoulder externally of said bottleneck adjacent said second means, said cap skirt being adapted to seat against said second shoulder upon threaded engagement with said second means.

4. The self-sealing bottle assembly set forth in claim 3 wherein said aperture diameter is substantially equal to said internal diameter.

5. A method of constructing a self-sealing bottle for carbonated beverages or the like comprising the steps of: (a) providing a bottle having an open bottleneck extending therefrom with an internal shoulder formed adjacent the neck opening, (b) placing a sealing sphere into said bottle through said neck opening, (c) locating an annular resilient seal on said shoulder adjacent said neck opening, and (d) shrink-fitting a cap onto said bottleneck to capture said seal against said shoulder, gripping force of said cap on said bottleneck being sufficient substantially to prevent removal of said cap, seal and sphere by a user.

6. The method set forth in claim 5 wherein said bottle is composed of glass material and said step (a) includes the step of providing a plurality of discontinuities around the external surface of said bottleneck adjacent said opening, and wherein said cap is composed of thermosetting plastic material and said step (d) includes the step of press fitting said cap over said bottle opening while said cap is hot such that said cap firmly envelops and grips said bottleneck upon cooling to room temperature.

7. The method set forth in claim 6 wherein said plurality of discontinuities comprises external threads surrounding said bottle opening.

* * * * *